US005199996A

United States Patent [19]

Jonas et al.

[11] Patent Number: 5,199,996

[45] Date of Patent: Apr. 6, 1993

[54] APPARATUS AND METHOD FOR CLEANING FLOORS

[75] Inventors: André Jonas; Bernard Jonas, both of Le Rouret, France

[73] Assignee: Azurtec, France

[21] Appl. No.: 745,834

[22] Filed: Aug. 16, 1991

[51] Int. Cl.[5] ..... A47L 9/28; A47L 5/36; B08B 5/04

[52] U.S. Cl. ..... 134/21; 15/315; 15/319; 134/18

[58] Field of Search ..... 15/315, 319; 134/21, 134/18

[56] References Cited

U.S. PATENT DOCUMENTS

| | | | |
|---|---|---|---|
| 3,345,671 | 10/1967 | Wilson et al. . | |
| 4,019,219 | 4/1977 | Willenborg . | |
| 4,306,329 | 12/1981 | Yokoi | 15/319 |
| 5,086,535 | 2/1992 | Grossmeyer et al. | 15/319 |
| 5,095,577 | 3/1992 | Jonas et al. | 15/315 |

FOREIGN PATENT DOCUMENTS

| | | | |
|---|---|---|---|
| 642539 | 6/1962 | Canada | 15/315 |
| 675552 | 12/1963 | Canada | 15/315 |
| 274310 | 7/1988 | European Pat. Off. . | |
| 2076110 | 1/1971 | France . | |
| 2084470 | 3/1971 | France . | |

OTHER PUBLICATIONS

Engineering, (Incl. Machine Shop Magazine) vol. 229, Jun. 6, 1989, London, GB "Robot Vehicle Copes With the Cleaning".

*Primary Examiner*—Chris K. Moore
*Attorney, Agent, or Firm*—Hoffman, Wasson & Gitler

[57] ABSTRACT

The invention relates to a cleaning apparatus comprising a cleaning device placed on a first side of the apparatus to perform a cleaning apparatus perpendicular to the general direction of advance of the apparatus. The apparatus could also include a second lateral cleaning device located on a side opposite the first side of the apparatus, to perform, simultaneously with the first cleaning device, the desired cleaning operation perpendicular to the general direction of advance of the apparatus, so as to be able to complete the entire cleaning operation without it being necessary for the apparatus to proceed along a wall.

12 Claims, 7 Drawing Sheets 23
12
11
7
10
3
14
8
13
19
9
2
22b
22a
18
7

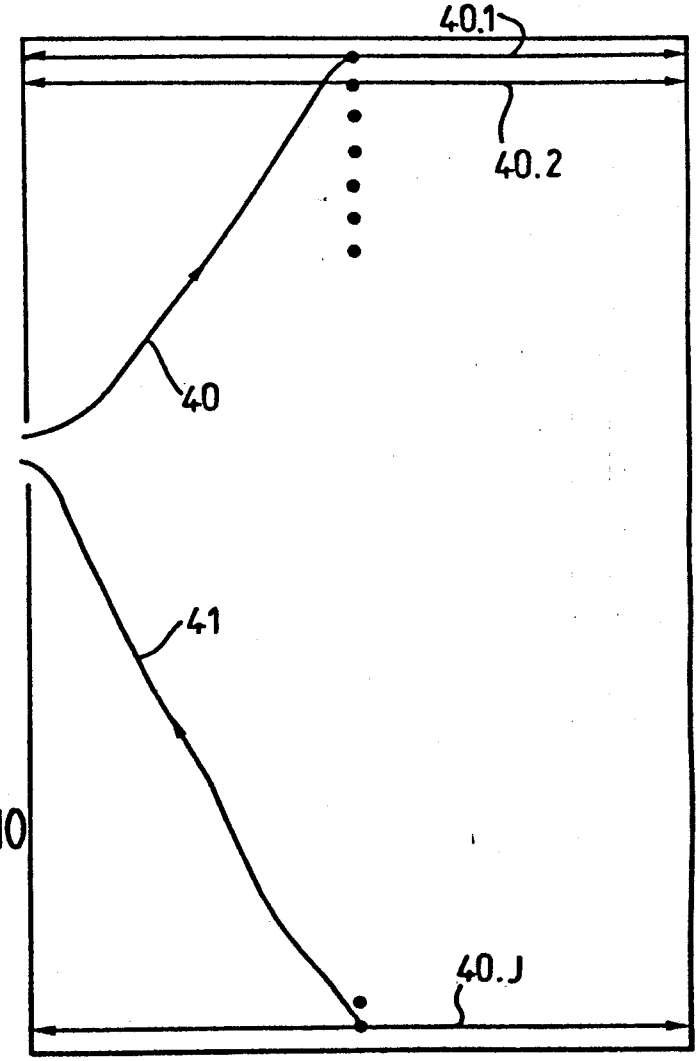
FIG. 9
FIG. 10
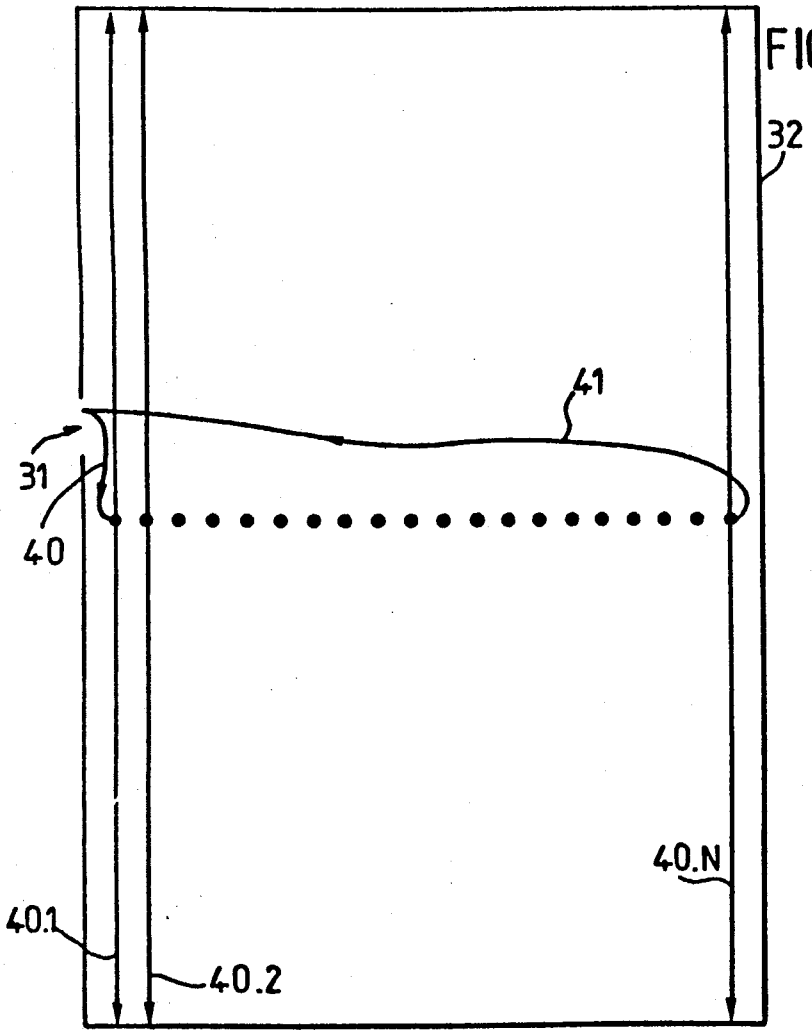

APPARATUS AND METHOD FOR CLEANING FLOORS

BACKGROUND OF THE INVENTION

The invention relates mainly to a method and apparatus for cleaning floors.

It is known to make apparatuses for the automatic or semi-automatic cleaning of floors. These apparatuses must perform a complete sweeping or cleaning of the surface of the floor to be cleaned. An example of a particularly efficient apparatus is described in French Patent 86 17356. This apparatus, moving along the walls of the room to be cleaned, includes a cleaning device or devices that are deployed in a direction perpendicular to the general direction of advance of the apparatus. The sweeping or cleaning actions are initially performed while the apparatus is at rest. Thus, after the cleaning of a first strip of floor has been performed, the apparatus advances by a length that is less than the width of the cleaned strip of floor, and the operation of deploying the cleaning devices is then repeated.

However, this device exhibits many drawbacks. Furthermore, this prior art device is cylindrical and must be able to pass through the doors and the standard openings made in buildings to allow access therein. It is found, therefore, that its diameter and consequently its surface on the floor are very limited. Thus, its stability is precarious. Further, the wheels are of a small diameter and the motors generate a relating small amount of power. The apparatus, proceeding along both walls, must travel a considerable distance, thus lengthening the cleaning time.

In this prior art device, it is possible to limit the length of the deployment of a hose provided with a cleaning nozzle. Normally, this length of deployment is equal to half of the width of the room. Even in this case, there are surfaces, particularly at the corners of the room, that are cleaned several times, this successive cleaning lengthens cleaning time. Additionally, the distance of travel corresponds to the length of the four walls of the room, possibly increased by obstacles that the apparatus must negotiate, thereby resulting in a cleaning time of a typical room of approximately six minutes. The width of the nozzle is limited to half the diameter of the apparatus. The small diameter of the prior art would limit the width of the nozzle to approximately 26 cm. Therefore, the complete cleaning of a typical room would necessitate performing a large number of sweeps, a source of delay.

The prior art apparatus must proceed along the walls of the room, thereby creating a track in the floor caused by the wheels. Also, the rotation of the guiding wheel is always performed exactly at the same place, which risks causing wear or at the very least, marking of the carpets.

SUMMARY OF THE INVENTION

The device according to this invention makes it possible to eliminate the above-noted drawbacks. For example, the present invention is constructed in a rectangular shape. Thus, for a given width, less than the width of the smallest opening that must be able to be passed through, the apparatus according to this invention has a larger surface. Thus, it is possible to adapt a cleaning device, for example, nozzles, of greater widths (typically 40 cm).

The cleaning apparatus according to this invention comprises, mounted on each of its sides, a cleaning device that can be deployed perpendicular to the general direction of advance of the apparatus. The use of at least one cleaning device on each side of the apparatus, according to this invention, frees it of the necessity of proceeding along the walls. Thus, the cleaning apparatus no longer requires a guiding device and can advantageously be propagated in a straight line, as long as it encounters no obstacles in its path.

Furthermore, it has been observed that it was not possible to increase the speed of deployment of the cleaning devices without comprising the cleaning quality. For example, in the case of a vacuum cleaning device, a nozzle should not advance at a speed greater than 1 or 1.5 meters per second. However, the cleaning speed is increased by the presence of two cleaning nozzles moving in approximately opposite directions.

Cleaning apparatuses having more than one cleaning device on each of their sides are not beyond the scope of this invention. In this case, the swept surface is again increased and consequently the time for cleaning the room is decreased.

By using a device according to this invention, the cleaning is performed more quickly if the general direction of advance of the apparatus follows the middle of the room. In this case, the path of deployment of each of the cleaning devices located on both sides of the apparatus is the same. However, it is not at all necessary for the proper operation of the apparatus that it proceed exactly in the middle of the room. In practice, there can be considerable variations in relation to this path in the middle of the room. Consequently, the wear of the carpet by the apparatus will be distributed over a considerable surface. Thus, premature wear and marking of the floor covering—particularly sensitive in the case of carpeting—will be avoided.

The apparatus according to this invention is particularly efficient in the case of cleaning offices. Actually, this type of cleaning is rather quick, the bulk of the time being spent, in addition to the cleaning of the floor, performed by the apparatus according to this invention, in the emptying of ashtrays and trash cans. In such a case, the cleaning staff is constrained by the slowness of the prior art cleaning apparatuses.

In a first variant embodiment, the apparatus according to this invention includes a drive motor. After positioning the apparatus and providing a start command, the apparatus comes to a stop, performs the cleaning of a first strip of floor, continuously advances by a predetermined length, (for example, at a speed of 0.15 m/sec) and performs the deployment of the cleaning device for cleaning the next strip. The operations are continued until the apparatus, according to this invention, runs into an obstacle. In this case, an obstacle detector, provided on the apparatus, assures the immobilization of the apparatus. In the case where the obstacle encountered consists of a wall of the room to be cleaned, the cleaning is terminated. The cleaning staff can use the apparatus, according to this invention, to perform the cleaning of the next room.

In the case where the cleaning of the room is not terminated, for example in the case where the obstacle consists of a piece of furniture, the cleaning staff perform the necessary maneuver for avoiding or removing the obstacle, after which the cleaning operation continues. For example, these maneuvers are performed by a control handle.

Advantageously, the apparatus, according to the invention, includes a remote signal receiver. This apparatus is able to obey, the remote signals for changing the general direction of advance, the signals for changing speed of advance, the signals for changing the pitch of advance (therefore of swept strip width), and/or the signals of speed of sweeping by the cleaning apparatus. Advantageously, a wireless remote is used, employing, for example, electromagnetic signals in the infrared spectrum.

The cleaning of a room necessitates traveling its length or its width. Advantageously, the device according to this invention includes a drive device making it possible for it to travel with a high speed, for example, between 0.2 and 1 m/second, typically 0.5 m per second, to clean the room. This drive device could consist, for example, of a powerful electric motor connected to drive wheels of large diameter.

A low-cost variant embodiment of the apparatus according to this invention, need not include the drive device. In such a case, the production cost approximates existing manual apparatuses which make a very wide distribution of the cleaning apparatus, according to the present invention, possible. The user of this variant pushes the apparatus according to this invention along a length equal to, or slightly less than the width of the cleaning nozzle (for example, about 35 cm). During this time, a front nozzle cleans the floor over a width at least equal to the width of the apparatus. With the apparatus immobilized, the user, for example, by pressing an electric switch, triggers the unwinding of the lateral cleaning device or devices, including hoses and nozzles. The hoses are unwound to reach the walls (or another obstacle), and are then rewound into the cleaning apparatus. The cleaning of a first strip has been completed and the user advances the apparatus for the cleaning of the next strip. This operation is repeated until the desired cleaning of the entire room is completed. As in the case of the first variant embodiment, the cleaning is achieved by parallel strips perpendicular to the general direction of advance of the apparatus.

A considerable autonomy is obtained for the apparatus, according to this invention, by utilizing a local electric power supply. This, for example, is accomplished by a cord that is unwound from a winder and that passes over a rod of considerable height that prevents the cord from catching on obstacles. However, in certain cases, the presence of obstacles can, in the presence of a cord, hinder the operations of the apparatus. Further, it is often necessary to plug in the apparatus when arriving in each room and to unplug it when leaving it. These operations produce delay. Thus, advantageously, the device according to this invention can include electric batteries supplying the necessary power for operation.

The invention has mainly as its object to provide a cleaning apparatus including a cleaning device placed on a first side of the apparatus to perform a cleaning operation perpendicular to the general direction of advance of the apparatus and a second lateral cleaning device located on the side opposite the first side of the apparatus to perform—simultaneously with the first cleaning device—the desired cleaning operation perpendicular to the general direction of advance of the apparatus, so as to be able to perform the desired cleaning without it being necessary for the apparatus to proceed along a wall.

BRIEF DESCRIPTION OF THE DRAWINGS

The invention will be better understood by the following description and the accompanying figures given nonlimiting examples in which:

FIG. 9 is a diagram illustrating a second example of frame sweep using the apparatus according to this invention;

FIG. 10 is a diagram illustrating a third example of frame sweep using the apparatus according to this invention.

In FIGS. 1 to 10, the same references have been used to designate the same elements.

DETAILED DESCRIPTION OF THE INVENTION

Figure 1A:
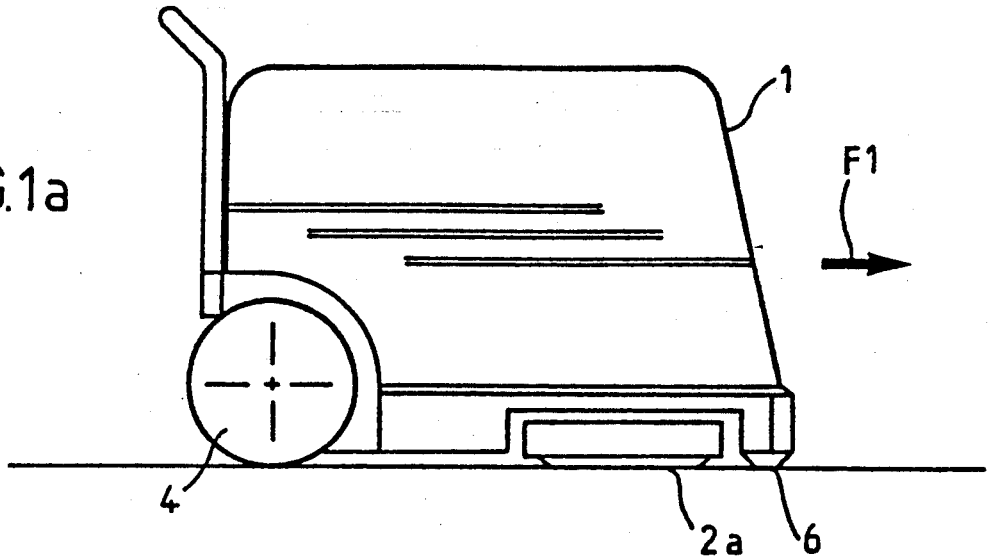
FIG. 1*a* is a side view of the apparatus according to this invention.

Referring to FIG. 1, a particularly efficient apparatus according to this invention is illustrated. This apparatus 1 has an approximately rectangular base, the front face corresponding to its width. This width is less than the width of the openings that the apparatus must be able to go through. Apparatus 1, according to this invention, includes on each of its sides cleaning means 2*a*, 2*b*. This arrangement is particularly efficient because it makes it possible to perform the cleaning of the entire area between the apparatus and lateral obstacles consisting of furniture or the wall of the room to be cleaned. Thus, in contrast with the prior art devices, it is no longer necessary to proceed along the walls. The apparatus is thereby simplified to the extent that it no longer comprises a device for guiding along and around these obstacles. The apparatus, according to this invention, includes the cleaning devices 2*a*, 2*b* on each of its sides, creating an effective cleaning operation possible from any position. Thus, useless operations are avoided. Further, by avoiding the systematic passage of the apparatus over the same path, the marking of the floor covering is avoided.

Figure 1B:
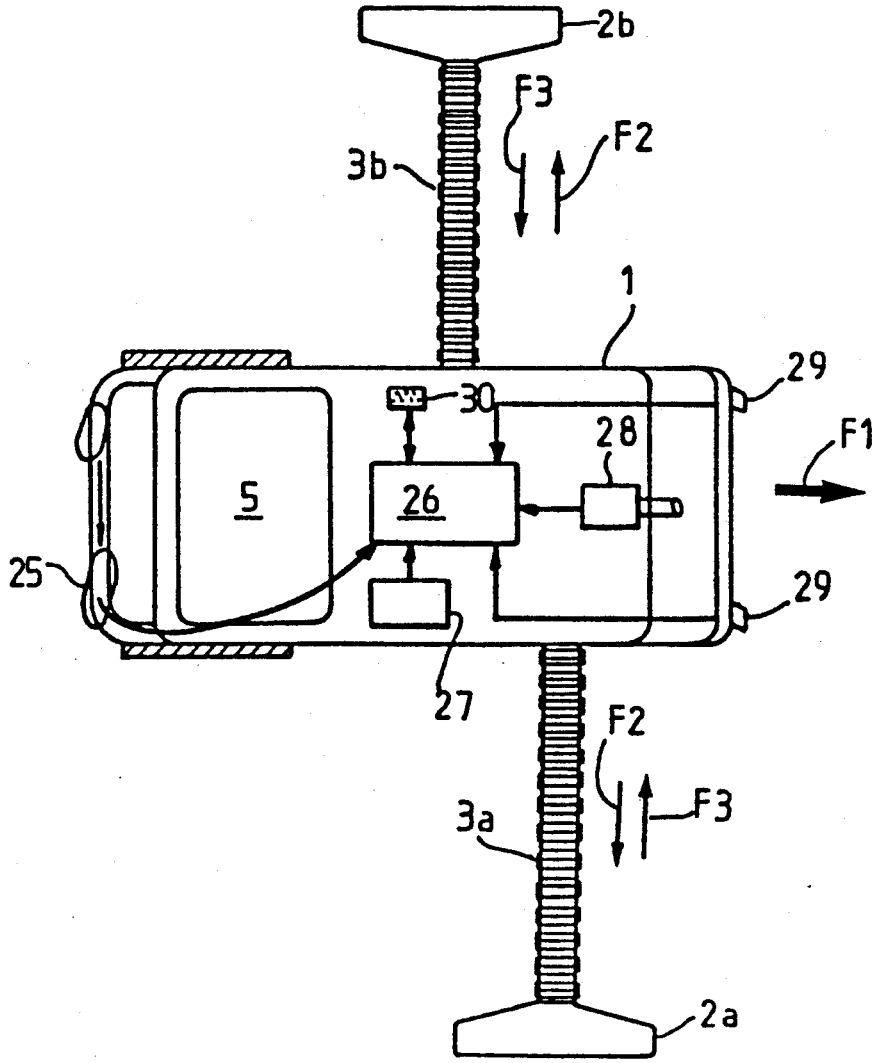
FIG. 1*b* is a top view of the apparatus according to this invention.

In the example illustrated in FIG. 1, cleaning means 2*a*, 2*b* are vacuum cleaner nozzles. Vacuum cleaner nozzles 2*a*, 2*b* are connected to the apparatus 1 by suction hoses 3*a*, 3*b*. with apparatus 1 immobile, cleaning means 2*a*, 2*b* are unwound simultaneously, approximately perpendicular to the apparatus 1 along arrows F2 (FIG. 1*b*). The hoses and nozzles return to apparatus 1 by following the same path (reference F3 in FIG. 1*b*). The apparatus advances by actuating a front nozzle 6 of a width approximately equal to the width of apparatus 1. During cleaning, the advance of apparatus 1 according to this invention determines the width of the strip to be cleaned at each sweep of cleaning means 2*a*, 2*b*. Consequently, the advance of apparatus 1, during cleaning, is less than or equal to the width of nozzles 2*a*, 2*b*, typically 40 cm. However, the pitch of advance can be less, for example equal to 20 cm. Therefore, the floor of the room will be cleaned twice producing a more thorough cleaning. The pitch of advance will therefore be selected as a function of the dirtiness of the floor and of the quality of the cleaning desired.

Of course, this invention is not limited to the use of vacuum cleaner nozzles. The use of other cleaning means such as, for example, shampooers or polishers does not go beyond the scope of this invention.

This invention is also not limited to the use of a single cleaning device on each side. The use of two, three, or more identical cleaning devices makes it possible to increase the width of the strip cleaned at each stop (along F1) of apparatus 1. The use of additional cleaning devices makes it possible to perform a complete cleaning in a single pass, for example a first vacuum cleaner nozzle intended to remove dust, followed by a polisher to polish the floor can be used.

In a first example of embodiment of apparatus according to this invention, no internal drive device is included to move the apparatus along Fi. Thus, the production cost is reduced and approximates existing manual apparatuses. In this case, the user pushes the apparatus in front of him in the general direction of advance F1. To perform the cleaning of a strip, the user sets up and triggers a device for controlling the unwinding of cleaning device 2*a*, 2*b*. Hoses 3*a*, 3*b* are completely unwound, and then wound up again to clean a particular strip. In case of an obstacle encountered by the nozzle 2*a*, 2*b*, an electric contact controls the withdrawal of hose 3*a*, 3*b*.

The user advances apparatus 1, in direction F1, a desired distance, for example, 35 cm. The operation recommences with the cleaning of the next strip.

In a final variant, apparatus 1, according to this invention, includes a drive device (not shown in the figure), typically consisting of an electric motor. Advantageously, the electric motor is connected to drive wheels 4 of large diameter, for example, between 20 and 60 cm, typically 40 cm.

Advantageously, apparatus 1, according to this invention, includes a control device 26. Control device 26 automatically controls the advance of the apparatus in the general direction of advance F1.

Advantageously, apparatus 1, according to this invention, includes manual controls 25, for example placed on a handle located at the back of apparatus 1. Controls 25 are connected to control device 26.

Advantageously, apparatus 1 comprises a remote signal receiver 27. Advantageously, a wireless remote is used, typically an infrared remote. Advantageously, the remote makes possible the complete driving of the apparatus, and particularly to control the rapid movement of the apparatus to bring it to a desired point, to control the triggering of the cleaning process, to regulate the pitch of advance and optionally other cleaning parameters. During the operation of apparatus 1, according to this invention, the operator can tend to other tasks such, as for example, emptying trash cans and ashtrays.

In another embodiment, the apparatus according to this invention, can be preprogrammed. this makes it possible, for example, to perform a repetitive cleaning of the same room or to automatically perform the cleaning of a large number of offices, whose layout is known in advance. Advantageously, apparatus 1, according to this invention, includes a connection or an interface 30 that enables control device 26 to be in communication with a remote device. Thus, it is possible to program control device 26 by means of a microcomputer or an outside terminal.

Advantageously, the apparatus according to this invention comprises obstacle detectors 29 on its front face.

A cleaning apparatus equipped with other data acquisition means such as, for example, a television camera 28 is also not beyond the scope of this invention.

Advantageously, control device 26 controls the operation of apparatus 1 and detects operating anomalies such as, for example, the fact that a dust bag 5 is completely full.

To assure the profitability of apparatus 1, according to this invention, it is essential to reduce the cleaning time as much as possible, and to reduce the probability of breakdowns. The speed of movement along paths F2 or F3 of cleaning devices 2*a*, 2*b* can therefore be close to the maximum speeds possible to obtain an effective cleaning. This speed depends on the nature of the floor, and is on the order of magnitude of 1 m to 1.5 m per second for a vacuum cleaner nozzle being moved over a carpet.

Figures 2, 3:
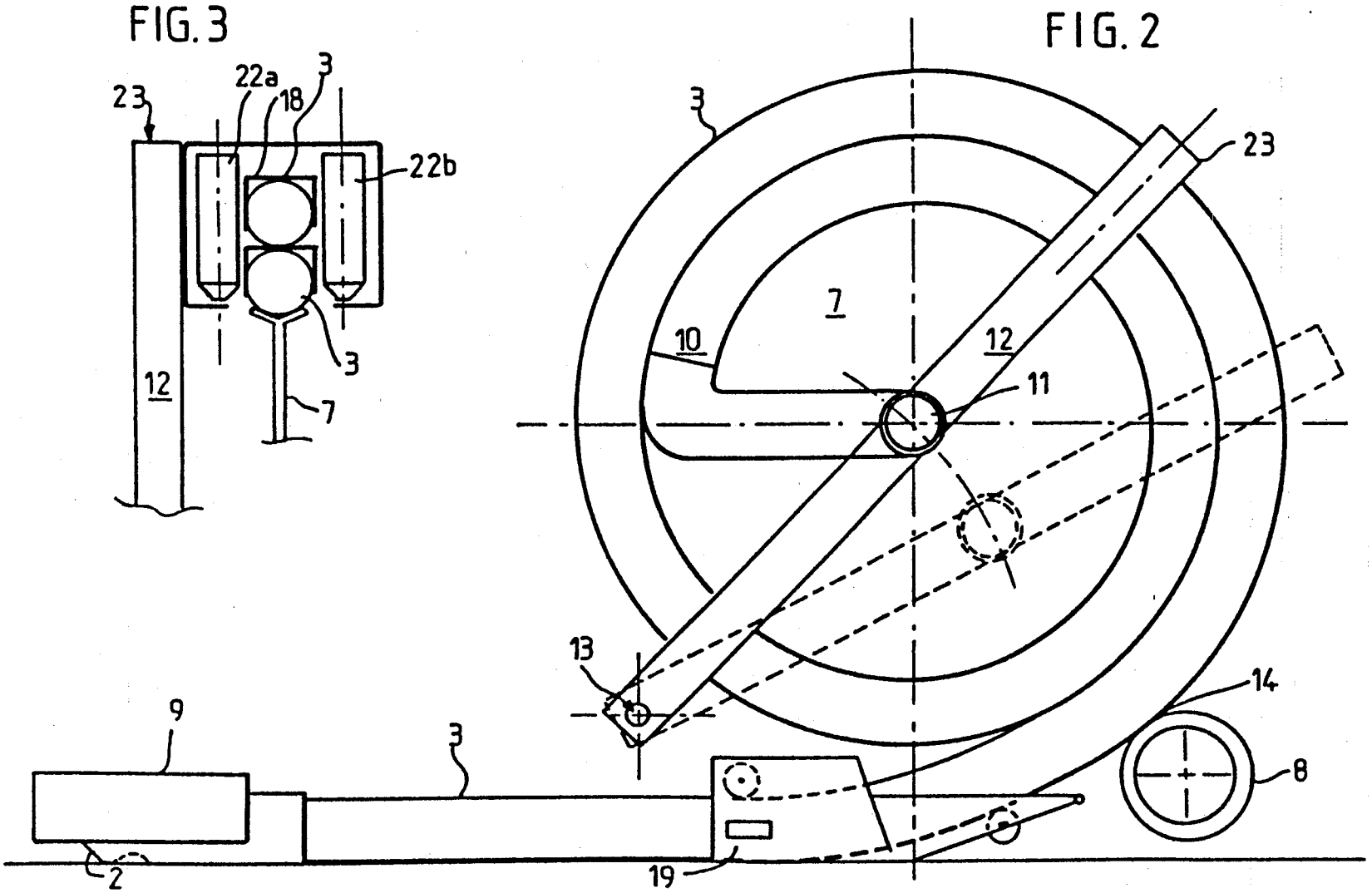
FIG. 2 is a view of a suction hose winder that can be used in the apparatus according to this invention.
FIG. 3 is a view of an embodiment detail of the device of FIG. 2.

FIGS. 2 and 3, illustrate a particularly efficient example of the motorization device of cleaning device 2 can be seen. As shown therein, hose 3 is coiled on a pulley 7. Pulley 7 is carried by a movable arm 12 mounted in rotation around a pin 13 at its lower end. Hub 11 of pulley 7 is placed approximately in the center of movable arm 12. In the example illustrated in FIG. 2, inner end 10 of hose 3 is connected by its intermediate member to a dust bag.

The driving of hose 3 is provided by a motorized drive roller 8. Roller 8 has a point 14 of contact with the outer turn of hose 3. Thus the curvature of hose 3 at point 14 and the pressure that it exerts on rollers 8 are virtually constant and do not depend on the number of turns of hose 3 wound on pulley 7. Roller 8 provides a drive at a constant linear speed for hose 3. Thus, cleaning devices 2*a*, 2*b*, equipped with their covers 9, travel the surface to be cleaned at an optimal speed. Of course, the use of a drive pulley 8 mounted on a movable arm to rest on the outer turn of hose 3 wound on a stationary pulley is not beyond the scope of this invention.

Advantageously, the apparatus according to this invention includes a configuration to improve the guiding of hose 3. For example, upper end 23 of movable arm 12 carries two rollers 22*a* and 22*b* that have their axes vertical. Advantageously, the apparatus according to this invention is equipped with braking means at the end of travel of hose 3.

Figure 5A:
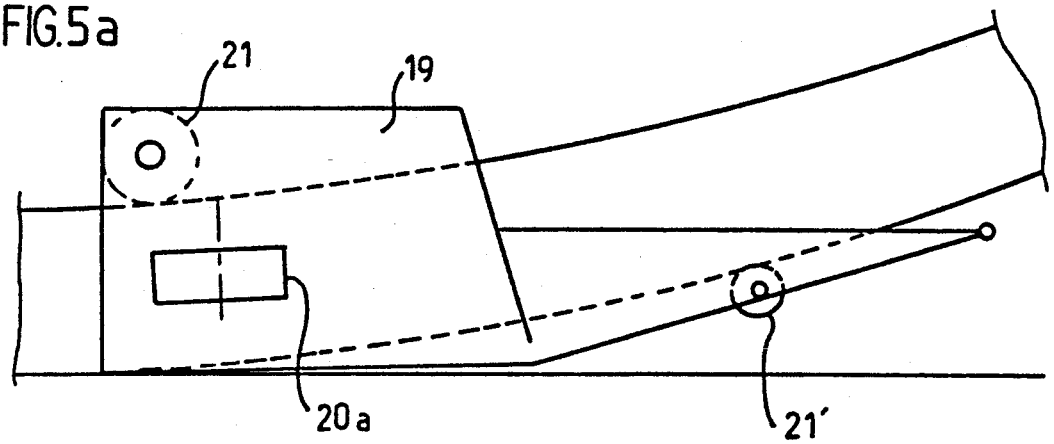
FIGS. 5*a* and 5*b* illustrate a chute that can be used in the apparatus according to this invention.
Figure 5B:
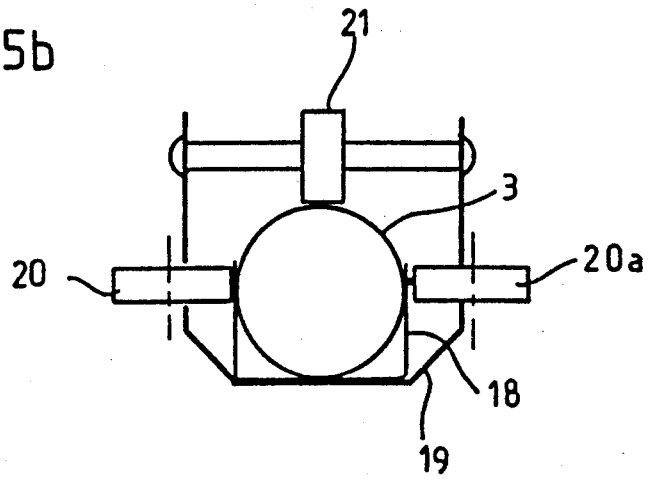

Advantageously, the apparatus according to this invention comprises a guide chute 19 illustrated in FIG. 5. Chute 19 comprises on both its sides two guide bearings 20*a*, 20*b* and a roller bearing 21 on the upper part of hose 3. Before arriving in chute 19, hose 3 is guided by a lower roller bearing 21'.

Figure 4A:
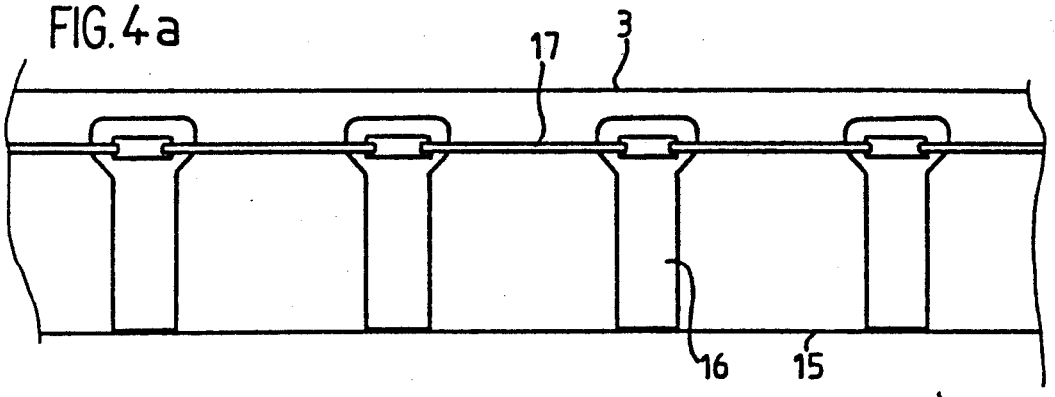
FIGS. 4*a*, 4*b* and 4*c* illustrate the stiffening of the suction hose that can be used in the apparatus according to this invention.
Figure 4B:
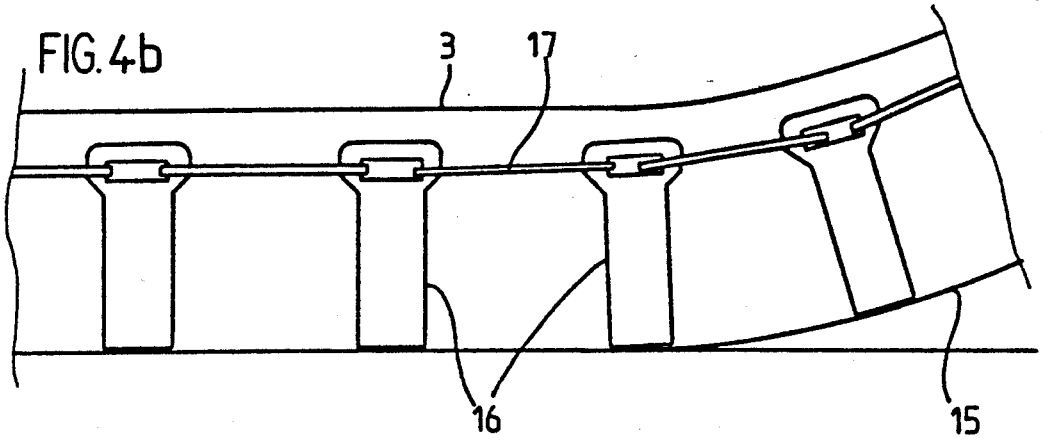
Figure 4C:
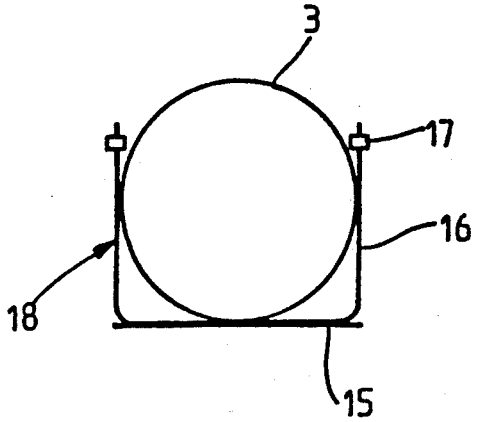

Hose 3 must be able to be wound on pulley 7 While having sufficient stiffness to be able to be unwound satisfactorily. To accomplish this, it is advantageous to stiffen hose 3. A particularly efficient means for stiffening a hose 3 is illustrated in FIG. 4 which shows the use of a flexible metal blade 15. Hose 3 is fastened to the metal blade 15 by clips 16 welded to it. Links 17 are attached to openings made in clips 16. When the hose is unwound flat, links 17 are taut, as illustrated in FIG. 4*a*. On the other hand, when hose 3 is folded, for example, it is to be wound on pulley 7, links 17 enter with play inside the openings made in clips 16, as illustrated in FIG. 4*b*. Metal blade 15 and clips 16 equipped with links 17, as a whole, form a channel 18 in Which the hose 3 fits. The channel 18 makes possible the winding and unwinding of hose 3 by giving it a longitudinal stiffness and by not allowing buckling.

Advantageously, pulley 7 is equipped with a return spring, not shown in the figure, which is stretched during the unwinding of hose 3 and whose action helps to increase the winding of the hose.

Figure 6A:
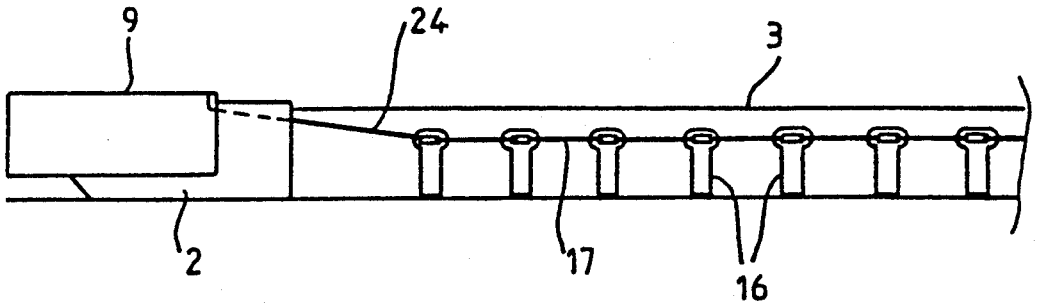
FIGS. 6*a* and 6*b* show side views of the suction hose that can be used in the apparatus according to this invention.
Figure 6B:
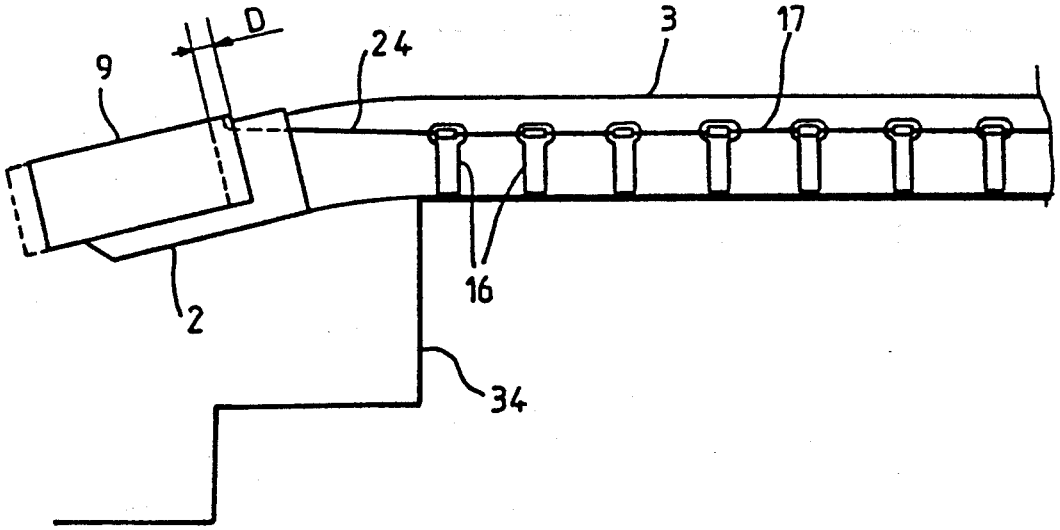

To avoid damaging the apparatus according to this invention, and particularly hose 3, it is essential to detect the presence of obstacles such as, for example, the walls, furniture, or stairs. The device according to this invention comprises at the end of cleaning device 2, electric contacts that detect furniture or wall-type obstacles. In FIG. 6, an end cover 9 of cleaning means 2 has been illustrated that makes it possible to detect a difference in level greater than a predetermined threshold. In the case illustrated in FIG. 6*b*, this difference in level corresponds to a stair step 34. In this case, cleaning device 2 hangs in space and stretches out a rod 24, for example, fastened to the end of links 17. Hanging in space, covers 9 is moved a distance D and closes electric contacts, indicating the presence of an obstacle. Based upon this signal, apparatus 1 assures the withdrawal of the cleaning device 2 by rewinding the hose 3 on pulley 7.

Figures 7, 8:
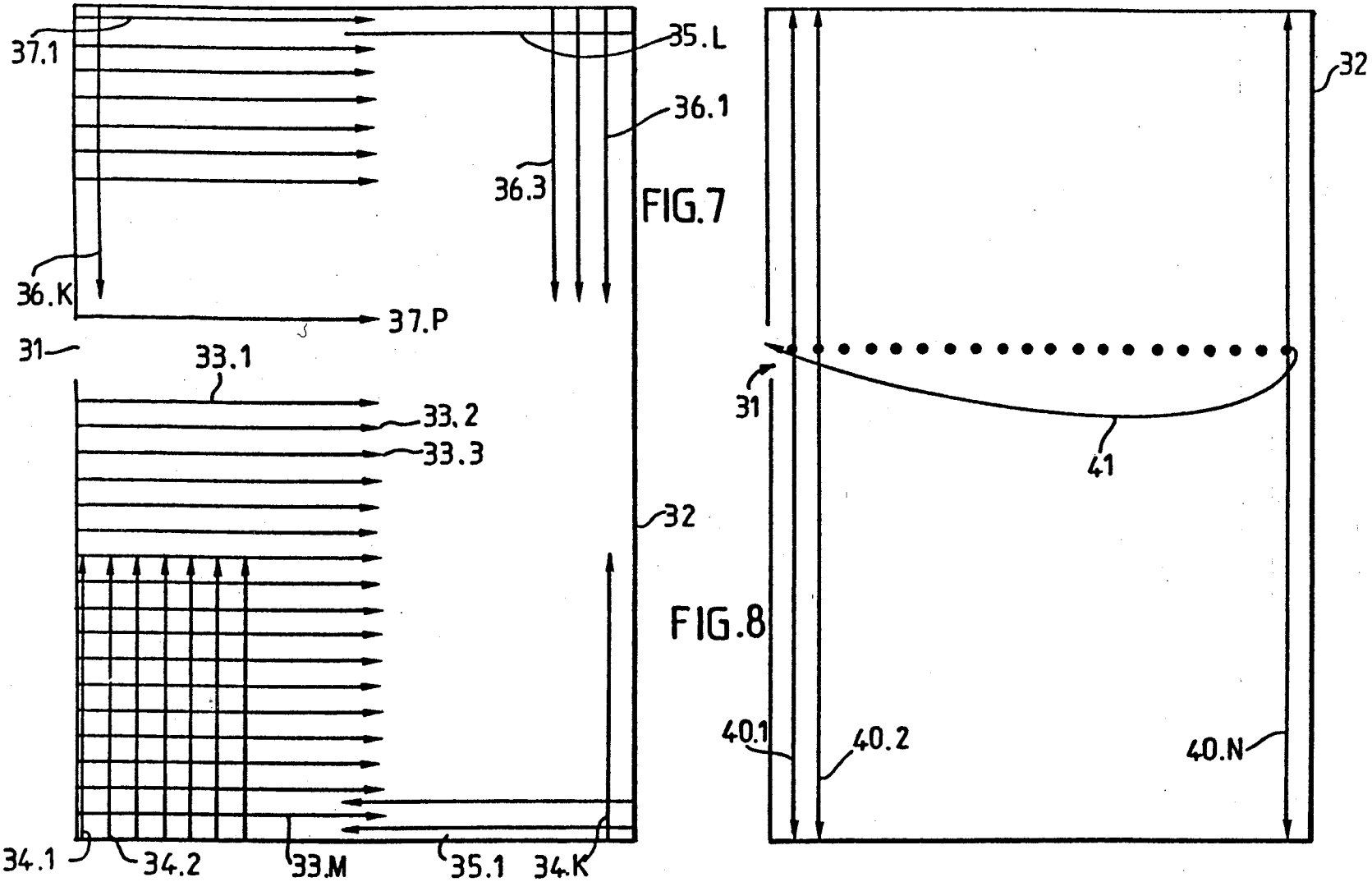
FIG. 7 is a diagram illustrating the frame sweep of an apparatus of known type.
FIG. 8 is a diagram illustrating a first example of frame sweep using the apparatus according to this invention.

FIG. 7 illustrates the frame sweep performed by a prior art clearing apparatus that follows the wall. The cleaning apparatus enters room 32 through door 31, and then, turning to the right, it performs sweeps 33.1 to 33.M successively. At this point, the apparatus is in the corner of the room and performs a rotation of 90°. Continuing the cleaning apparatus, the apparatus performs the sweeping of lines 34.1 to 34.K. A new rotation allows the apparatus to perform the sweeping of lines 35.1 to 35.L, followed by lines 36.1 to 36.K and 37.1 to 37.P. At this point, the room is cleaned, except for the extension of door 31.

Such a process is extremely slow. For a room of average size, it corresponds to about 6 minutes. Several factors influence the slow speed of the cleaning operation:

1) The prior art apparatus travels the length of the four walls delimiting room 32, possibly increased by the distance required to pass around obstacles (not shown in the figure). Furthermore, lines 34.1 to 34.K and 36.1 to 36.K perform a sweeping of a surface already swept, particularly by lines 33.M and before, 35.1 and after, 35.L and before, and 37.1 and after;

2) The apparatus performs the cleaning only on a single side, employing a nozzle of reduced width.

The apparatus according to this invention can perform the cleaning of room 32 by traversing the room using several approaches. Three examples of travel have been illustrated in FIGS. 8, 9 and 10.

In FIG. 8, the apparatus, according to this invention, enters through door 31. The apparatus travels in a straight line, sweeping lines 40.1, 40.2, up to 40.N. Thus, room 32 is entirely cleaned, and the apparatus according to this invention, now available, performs the return distance 41 at great speed, for example, to clean the next room or office.

In FIG. 9, the apparatus, after having entered through door 31 traverses path 40 at great speed to be again in the middle of the length of room 32, perpendicular to the wall. At that moment, the sweeping of lines 40.1 to 40.N begins. The entire room 32 having been swept, the apparatus performs a return 41 at great speed.

In the case illustrated in FIG. 10, the apparatus traverses paths 40 at great speed so that it is situated in the middle of the width of room 32, perpendicular to the wall. The apparatus then performs the sweeping of lines 40.1 to 40.J. Once the sweeping of the room is completed, the apparatus leaves it by traversing path 41 at great speed.

The positioning and the paths traveled by the apparatus are selected by the operator and/or by programming. When programming is used, it is possible to place markers in the environment of the apparatus to give it references for the place where it is located.

The invention applies particularly to the rapid cleaning of hotels, office buildings, or houses.

It may be seen from the foregoing, that the embodiments described herein are by way of illustration and not of limitation, and that various changes and other modifications of the construction, composition, and arrangement of parts are possible in light of the above teachings. Accordingly, it is to be understood that other embodiments of this invention could be utilized without departing from the spirit and scope of the present invention, as set forth in the appended claims.

We claim:

1. A cleaning apparatus for cleaning floor comprising:

a body provided with supporting wheels for moving said body in a first direction;

a first cleaning device provided with a cleaning nozzle and a hose capable of extending from said body in a direction perpendicular to said first direction; and a means for winding and unwinding said hose from within said body, said winding and unwinding means comprising a winder provided within said body onto which said hose is wound, said winder mounted on a movable arm, and a motorized roller provided in proximity to said winder, for driving by friction, said hose such that the contact is maintained between said roller and said hose, regardless of the amount of hose wound onto said winder.

2. The cleaning apparatus in accordance with claim 1, further including a second cleaning device provided with a cleaning nozzle and a hose capable of extending from said body at a side opposite of said first cleaning device in a direction perpendicular to said first direction, said cleaning apparatus capable of cleaning a particular area without the necessity of proceeding along a boundary wall of the particular area.

3. The cleaning apparatus in accordance with claim 1, wherein said hose is provided within a plurality of U-shaped stiff elements connected to one another by a plurality of flexible links.

4. The cleaning apparatus in accordance with claim 1, wherein said body includes a guide chute for winding and unwinding said hose, said guide chute provided with roller bearings on either side thereof.

5. The cleaning apparatus in accordance with claim 1, wherein said cleaning nozzle is a vacuum cleaner.

6. The cleaning apparatus in accordance with claim 1, wherein said body is provided with a remote signal receiver.

7. The cleaning apparatus in accordance with claim 1, wherein said body is provided within an internal source of energy.

8. The cleaning apparatus in accordance with claim 1, wherein said device is provided with a level sensor, to actuate said means for winding and unwinding said hose, if said level sensor senses an imbalance greater than a predetermined amount.

9. The cleaning apparatus in accordance with claim 1, further including a drive motor provided with said body.

10. A method of cleaning a particular area, such as a room surrounded by a plurality of boundary walls consisting of the steps of:

a) providing a cleaning apparatus having a body provided with supporting wheels with first and second cleaning devices, each having a cleaning-nozzle and a hose, said body capable of movement in a first direction, and said cleaning devices and said hoses capable of extending from said body in a direction perpendicular to said first direction, and said hoses capable of being withdrawn into said body;

b) said cleaning apparatus entering a particular area to be cleaned provided with at least two boundary walls provided opposite one another;

c) moving said cleaning apparatus to approximately the middle of one of the boundary walls, and in close proximity therewith;

d) extending said cleaning devices in a direction perpendicular to said first direction to clean a strip of floor;

e) rewinding said cleaning device into said body;

f) moving said cleaning apparatus in said first direction a distance less than the length of said cleaning nozzles;

g) repeating steps d), e) and f), until said cleaning apparatus reaches the opposed boundary wall; and h) having said cleaning apparatus exit the particular area to be cleaned.

11. The method in accordance with claim 10, further including the step of pre-programming the movements of said cleaning apparatus.

12. The method in accordance with claim 10, further including the steps of:

sensing the position and distance of the boundary walls with respect to said cleaning apparatus, utilizing an infrared transmitter/receiver;

controlling the movement of said body based upon information received in said sensing step; and extending said cleaning devices in said direction perpendicular to said first direction to claim a strip of floor based upon information received in said sensing step.

* * * * *